United States Patent [19]

Lowe et al.

[11] 4,097,929

[45] Jul. 4, 1978

[54] PROTECTIVE VISOR MEANS FOR A HELMET

[75] Inventors: Brian Arthur Lowe, Cheshunt; Raymond Odell, Potters Bar, both of England

[73] Assignee: RACAL-Amplivox Communications Ltd., England

[21] Appl. No.: 771,769

[22] Filed: Feb. 24, 1977

[30] Foreign Application Priority Data

May 14, 1976 [GB] United Kingdom ..... 20050/76

[51] Int. Cl.[2] ..... A61F 9/00

[52] U.S. Cl. ..... 2/10; 2/424

[58] Field of Search ..... 2/10, 424, 9, 441

[56] References Cited

U.S. PATENT DOCUMENTS 2,686,912 8/1954 Shipman ..... 2/9

3,774,239 11/1973 Kotzar ..... 2/10

3,858,242 1/1975 Gooding ..... 2/10

*Primary Examiner*—Alfred R. Guest

*Attorney, Agent, or Firm*—Lawrence E. Laubscher

[57] ABSTRACT

A protective visor comprises an arcuately curved frame having an aperture arranged to accept an arcuately flexed rectangular sheet of resilient transparent material. The sheet is retained in the frame by lugs extending into the aperture at staggered positions on the inner and outer margins of the upper and lower frame bars and has at the sides of the aperture recesses in the frame side bars into which the lateral edges of the transparent sheet will snap. The sheet may be of transparent polycarbonate and the frame of either transparent or opaque polycarbonate. Preferably the frame has at its upper corners hinge members for attachment to a protective helmet.

8 Claims, 3 Drawing Figures

PROTECTIVE VISOR MEANS FOR A HELMET

CROSS-REFERENCES TO RELATED APPLICATIONS

Co-pending application Ser. No. 775,634 filed on Mar. 8, 1977 by Anthony Graham Gorman and entitled IMPROVED FACE SEAL FOR PROTECTIVE HELMET describes an improved sealing means whereby passage of air between a visor of a protective helmet and the face of the wearer may be restricted.

Copending U.S. application Ser. No. 771,781 filed Feb. 24, 1977 in the names of Brian A. Lowe et al entitled "Protective Devices" relates to an improved anti-dust helmet including a sealing member so formed that an edge thereof that rests against the wearer's head approaches the head at an acute angle.

BACKGROUND OF THE INVENTION

With a number of hazardous industrial and other processes, it is necessary to protect the face and eyes of a worker by some protective panel in front of the face. Such a panel may consist of a transparent visor which has sufficient strength to resist the impact of dangerous substances or objects such as hot or cold splinters of metal.

With the exception perhaps of suitably toughened glass, there is no known and economically viable transparent material which will withstand for very long, the impact of the substances or objects from which the wearer of a protective visor is to be protected. Thermoplastic materials such as, say, polycarbonate in sheet form are commonly used for transparent protective visors and the outer surface can rapidly become damaged by the impact of the aforesaid substances or objects. Additionally the surface may become scratched if used in generally dusty environments, especially where the dust is of an abrasive nature. The damage to the visor seriously reduces the necessary optical clarity and the visor has to be replaced to avoid consequent inconvenience and perhaps danger to the user, arising from the reduced visibility and the visual flaring which can occur when light impinges on scratches etc., on the visor surface. Visor replacement costs can thus be high, due to the short life of the visor material and inconvenience is also caused by the requirement for frequent replacement.

It is known art to reduce this visor problem by using a replaceable visor of minimum size contained in an aperture with a shield or frame of larger size. The shield or frame may have a longer life expectancy than the transparent visor panel, thus reducing replacement costs. This application is concerned with an improved design of frame and with improved means of securing the visor panel in the frame to permit easy and quick replacement of the visor panel.

Existing visor frames tend to divide into two categories. One category consists of an opaque shield with a relatively small aperture for a visor panel. This type is commonly used for welding operations. The second category consists generally of a very narrow frame intended to hold a visor panel of large area to provide a large angle of vision. Such narrow frames tend to be flexible and non-sturdy and prone to damage, especially when the visor panel is not in position in the frame.

SUMMARY OF THE INVENTION

It is an object of the invention to provide a visor assembly yielding the largest possible viewing angle but with a frame having a long life expectancy.

It is a further object of the invention to provide a visor assembly including a frame member sturdy enough to enable the frame to be sealed to the sides of the face of the person wearing the visor.

It is another object of the invention to provide a visor assembly comprising a replaceable visor panel of very simple form to minimize its replacement cost.

An embodiment of the invention comprises a frame member bounding an aperture, said aperture having similarly arcuate upper and lower edges lying in parallel horizontal planes. The upper and lower frame portions have mutually offset lugs extending into the aperture at the inner and outer margins of the aperture and the side portions of the frame have inwardly facing grooves into which opposed edges of an initially flat sheet of transparent resilient material may be snapped when the sheet has been arcuately bent to fit within the frame aperture.

The new visor frame is a plastics moulding produced from any one of a number of suitable materials. Use of this manufacturing technique enables advantageous features to be an integral part of the frame design. Once the mould tool has been produced, the individual frames can be made quite cheaply. A suitable material for the said visor frame is polycarbonate. To make the frame in the same material as is known to be suitable for visor panels confers the same protective properties on the frame as on the visor panel.

Additionally although not necessarily, the frame can be made in an opaque polycarbonate. The scratching, pitting and so on which may occur on the outer surface is then unimportant and the usable life of the frame is further extended.

The synthetic plastic moulding technique, using a suitable synthetic plastic material, produces a frame of high rigidity and sturdiness, although the sections of the various areas of the moulded part are not particularly large. It is also possible to include moulded-in features which accept and effectively secure a simple design of visor panel, devoid of fixing attachments.

BRIEF DESCRIPTION OF THE DRAWINGS

Additional features and advantages of the invention will become apparent from the following description of a preferred embodiment thereof, taken in conjunction with the accompanying drawings, in which.

DESCRIPTION OF THE PREFERRED EMBODIMENT

Figure 1:
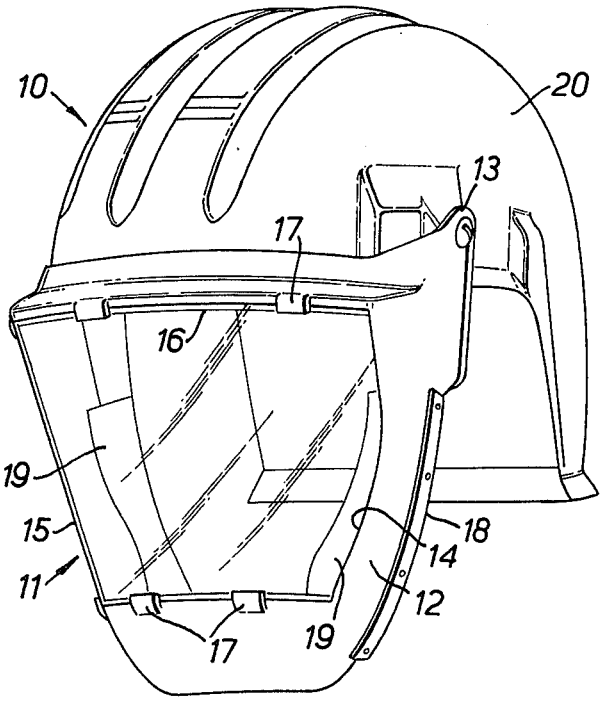
FIG. 1 shows a perspective view of the visor assembly.

FIG. 1 shows a perspective view of a dust helmet 10 including a visor assembly 11 in accordance with the invention. The visor assembly includes a frame member 12, advantageously itself transparent, which is attached by way of pivot lugs 13 to a helmet shell 20. The assembly 11 further includes a transparent viewing panel 15 snap-fitted in an aperture 14 bounded by frame member 12. The viewing panel 15 is retained in aperture 14 by staggered lugs 16*a* - 16*d*, 17*a* - 17*c* provided respectively on the inner and outer edges of aperture 14 and extending into the aperture. Advantageously the inner lugs 16 are flush with the inner surface of frame member 12 while the outer lugs 17 project from the general outer surface of the frame member. It is advantageous to provide at the rear edges 18 of frame member 12 a face sealing means arranged to restrict air flow between the sides of the visor assembly 11 and the face of a person wearing the helmet 20. These face seals are advantageously as described in above-mentioned copending application Ser. No. 775,634.

Figure 2:
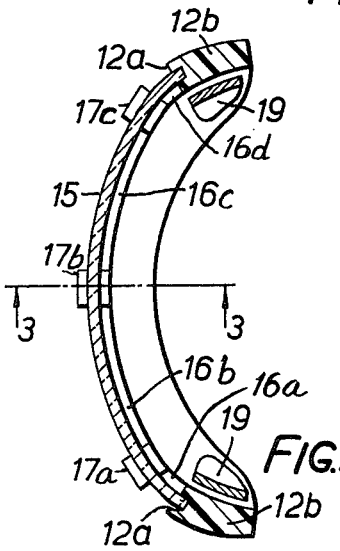
FIG. 2 shows a sectional plan view taken along line 2—2 of FIG. 3 and showing the visor panel retaining means at the lower edge of the visor panel aperture.
Figure 3:
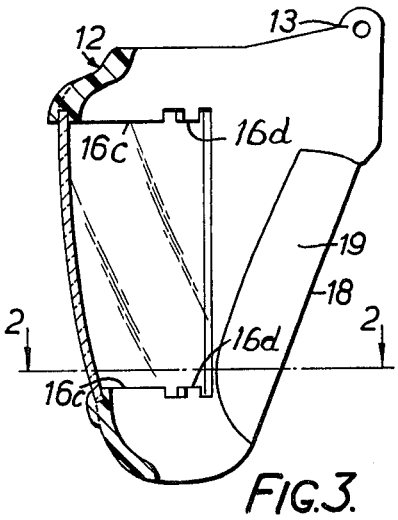
FIG. 3 shows a central vertical section through the visor assembly, taken along line 3—3 of FIG. 2.

FIG. 2 shows a sectional plan view of the visor, taken along the line 2 — 2 of FIG. 3. It will be seen that inner lugs 16 are disposed alternately with outer lugs 17, so that the inner and outer lugs are mutually offset to retain viewing panel 15 in its required curved form. The ends of panel 15 are retained in bevelled grooves 12*a* formed in the side portions 12*b* of frame member 12. The manner in which these panel-retaining elements operate is now described.

A visor panel 15, preferably but not necessarily of polycarbonate sheet, of a suitable thickness can be inserted into the visor frame by sliding the sheet with a horizontal motion behind the central and outer lugs 17*a*, 17*b*, 17*c*. By pressing gently on the rear surface of the visor panel in the region of one of the outer lugs 17*a*, 17*c* and by simultaneously pressing from the front at the vertical edge of the visor panel this edge can be snapped into position in the aforesaid groove 12*a*. Repeating this process secures the remaining vertical edge of the visor panel 15. Once the visor panel is in position in the aperture of the visor frame it can only be dislodged when intentionally required and is otherwise firmly retained in position.

Preferably, though not necessarily, the visor assembly includes face sealing members 19 attached to the side members 12*b* of the visor frame 12 at their rear edges 1 so as to restrict the passage of air between the visor and the wearer's face at the sides of the visor frame. These seals may advantageously be of the kind described in above-referenced co-pending Patent application Ser. No. 775,634.

An advantage of the visor assembly described is that all of the moulded visor panel retaining features of the visor frame can be produced without separate movable portions of the moulding tool and therefore manufacturing cost is reduced and moulding tool reliability is improved. Impact and ballistic testing has shown that a visor panel of semi-flexible synthetic plastic sheet is adequately retained so as to withstand the necessary impacts and to provide the required face and eye protection without the visor panel being dislodged.

The arrangement described provides a large viewing angle through the visor assembly but without requiring a larger and more costly visor panel which would otherwise be required if any known existing type of visor frame was used. The invention is aimed at reducing costs of replacement of various visor component parts and this aim is also achieved by the low cost obtained by the use of the moulded-in visor panel retaining features.

What is claimed is:

1. A protective visor assembly for helmets, comprising (a) a bowed frame member (12) formed from a synthetic plastic material, said frame member containing a generally rectangular aperture (14) having arcuate upper and lower edges contained in a pair of parallel spaced planes, respectively;

(b) an initially planar generally rectangular visor member (15) formed from a sheet of transparent resilient material; and (c) retaining means (16, 17 12*a*) integral with said frame for removably mounting said visor member in a bowed condition within said aperture, said retaining means including first means adjacent the upper and lower edges of said aperture causing the corresponding upper and lower edges of said visor member to conform to the arcuate configuration of said aperture upper and lower edges, respectively, and second means adjacent the lateral sides of said aperture arranged for cooperating engagement with the corresponding side edges of said visor member.

2. A visor assembly as claimed in claim 1, wherein said second retaining means comprises bevelled grooves formed in the frame portions bounding the lateral edges of said aperture, and further wherein said first retaining means comprises lug means extending into said aperture from the inner and outer surfaces of the frame portions bounding the top and bottom edges thereof.

3. A visor assembly as claimed in claim 2, wherein said lug means extending from said inner edge surface and said lug means extending from said outer edge surface of said frame portions are mutually offset.

4. A visor assembly as claimed in claim 3, wherein said inner lug means are flush with the inner surface of said frame member, and further wherein said outer lug means protrude from the outer surface of said frame member.

5. A visor assembly as claimed in claim 3 wherein said frame member is formed of opaque polycarbonate.

6. A visor assembly as claimed in claim 1, wherein said frame member and said visor member are each formed of polycarbonate.

7. A visor assembly as claimed in claim 1, wherein said frame member includes pivot lugs formed at the opposed upper corners thereof, whereby to amount said assembly pivotally on a protective helmet.

8. A protective visor assembly for helmets, comprising (a) a bowed frame member formed from a synthetic plastic polycarbonate material, said frame member containing a generally rectangular aperture having arcuate upper and lower edges contained in a pair of parallel spaced planes, respectively;

(b) an initially planar generally rectangular visor member formed from a sheet of transparent resilient synthetic plastic polycarbonate material; and (c) retaining means (16, 17 12*a*) integral with said frame for removably mounting said visor member in a bowed condition within said aperture, said retaining means including (1)integral lug means adjacent the upper and lower edges of said aperture for maintaining the upper and lower edges of said visor member in conforming arcuate engagement with the arcuate upper and lower aperture edges; and (2) bevelled groove means contained in the opposed lateral edges of said aperture for removably receiving the corresponding lateral edges of said visor member.

* * * * *